United States Patent [19]

Harmsen et al.

[11] 4,448,260

[45] May 15, 1984

[54] PIVOTAL BLADE SPIKES FOR TRACTORS

[75] Inventors: Wayne A. Harmsen, 607 Morris St., Fond du Lac, Wis. 54935; Arlyn V. Harmsen, Waupun, Wis.

[73] Assignee: Wayne A. Harmsen, Fond du Lac, Wis.

[21] Appl. No.: 366,311

[22] Filed: Apr. 7, 1982

[51] Int. Cl.[3] ..... E02F 3/12

[52] U.S. Cl. ..... 172/777; 172/136; 172/739

[58] Field of Search ..... 172/777, 136, 197, 618, 172/748, 712, 683, 734, 748, 739

[56] References Cited

U.S. PATENT DOCUMENTS

| | | | |
|---|---|---|---|
| 361,792 | 4/1887 | Sweet | 172/739 X |
| 1,524,369 | 1/1925 | Ramage | 172/739 X |
| 1,541,162 | 6/1925 | Mercer | 172/712 X |
| 2,219,160 | 10/1940 | White | 37/145 |
| 2,302,702 | 11/1942 | Leschinsky | 414/912 |
| 2,396,739 | 3/1946 | McCauley | 172/197 |
| 2,468,380 | 4/1949 | Smith | 172/777 |
| 2,475,710 | 7/1949 | McCauley | 172/197 X |
| 2,654,967 | 10/1953 | Small | 37/145 |
| 2,700,833 | 2/1955 | Small | 172/777 |
| 2,840,931 | 7/1958 | Appel | 172/136 X |
| 2,869,257 | 1/1959 | Braukly | 172/197 |
| 2,996,818 | 8/1961 | Buuck | 37/145 |
| 3,120,281 | 2/1964 | Peveler | 172/739 |
| 3,124,888 | 3/1964 | Jeffrey | 172/777 |
| 3,776,317 | 12/1973 | Royer | 172/777 |
| 4,117,890 | 10/1978 | Youngers | 172/734 |

FOREIGN PATENT DOCUMENTS

| | | | |
|---|---|---|---|
| 294395 | 7/1953 | Australia | 172/777 |
| 345 | of 1912 | United Kingdom | 172/739 |

*Primary Examiner*—Richard J. Johnson
*Attorney, Agent, or Firm*—Donald Cayen

[57] ABSTRACT

A universal earth-loosening attachment useful with earth-moving vehicles. The attachment mounts to the back side of tractor and bulldozer blades. The attachment includes a spike which engages the earth for loosening the earth during backward motion of the vehicle and which automatically swings upwardly to drag inoperatively on the earth surface during forward motion of the vehicle. Adjustment means allow the spike to engage the earth at an optimum angle relative to the earth grade for efficient operation. The spike is self-storing in an upright position.

7 Claims, 5 Drawing Figures

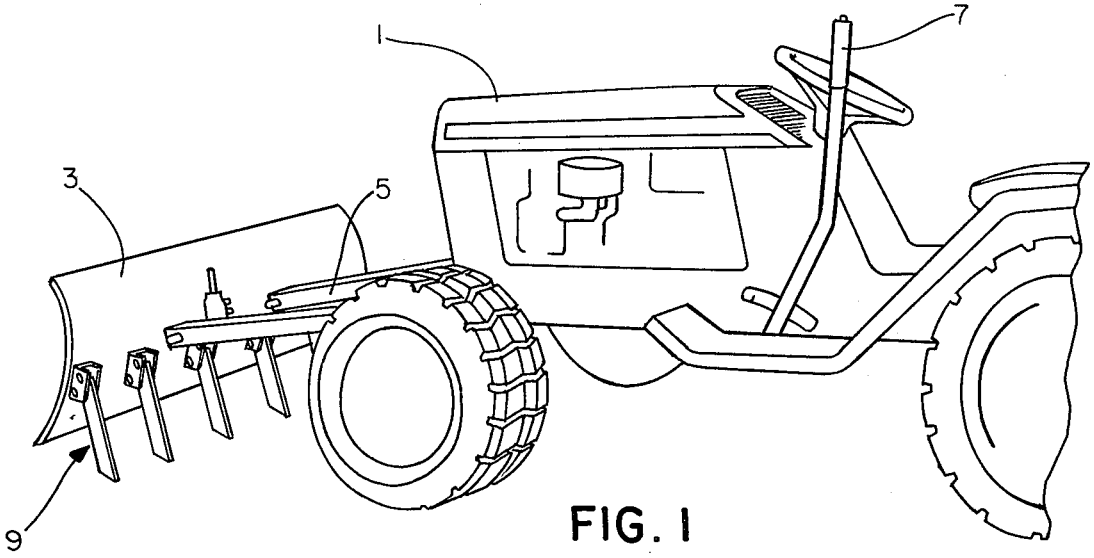
FIG. 1
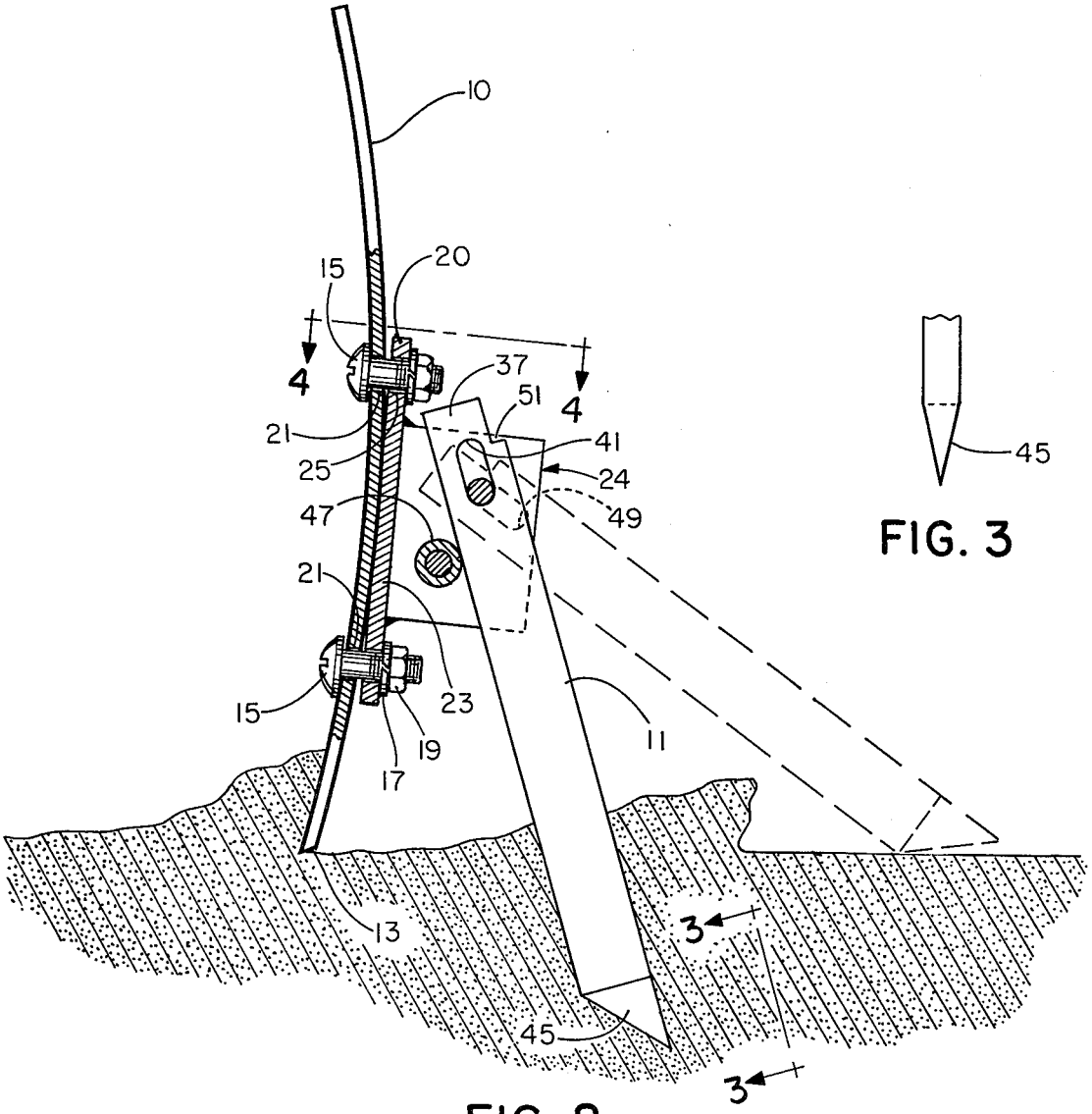
FIG. 2
FIG. 3

PIVOTAL BLADE SPIKES FOR TRACTORS

BACKGROUND OF THE INVENTION

A. Field of the Invention

This invention pertains to small tractors equipped with blades for moving earth, sod, and similar materials. In particular, the invention relates to pivotable spikes mounted to blades, the spikes being useful for ripping and loosening the earth while the tractor is moving in one direction and being inoperative while the tractor is moving in the opposite direction.

B. Prior Art

Attachments for tractors and bulldozer blades which are useful for loosening earth and other materials are known. One type of attachment consists of spikes which are permanently and rigidly mounted to the blade, such as shown in Jeffrey U.S. Pat. No. 3,124,888. The usefulness of this type of attachment is limited to blades which are tiltable about a horizontal axis independently of vertical motions of the blade. This type of tilting motion is usually not available on smaller tractors, and thus the rigid spike design has only limited application.

A second type of attachment consists of spikes which, although initially adjustable as to their placement relative to the grade of the earth, remain rigidly fixed in that placement until manually altered by the operator. This type of attachment is exemplified by Braukly U.S. Pat. No. 2,869,257. Because repositioning the spikes requires manual intervention before the blade can be used to scrape the loosened earth in a normal fashion, this design is limited for practical reasons to loosening operations which cover substantial areas. This is not feasible for the typical user of small tractors, who normally work relatively small areas of earth and find it burdensome to frequently raise and lower the spikes.

The spikes of a third type of loosening attachment operate so as to engage the earth to loosen it upon movement of the tractor in one direction and to automatically disengage from the earth to slide inoperatively on the surface when the tractor is moved in the opposite direction. This construction is typified by U.S. Pat. No. 2,219,160 to White, 2,396,739 to McCauley, and 2,996,818 to Buuck. These constructions, while of considerable value, are nevertheless heavy, complex, and expensive. They thus are not suitable for use on small tractors, but rather are limited to application on larger classes of earthworking machinery.

A final example of loosening attachments is the type which combines the automatically engaging and disengaging spike characteristics with the fixed spike characteristics. With this design, the operator has the option of allowing the spikes to pivot freely or to be firmly fixed to the blade. Examples of this construction are Small U.S. Pat. Nos. 2,654,967 and 2,700,833. These types of structures are permanently mounted to the tractor or bulldozer blade. They are costly and heavy and thus not suitable for use on small tractors.

SUMMARY OF THE INVENTION

In accordance with the present invention, there is provided a universal earth-loosening attachment that is readily mountable to and removable from the blades of earth-working vehicles. The invention preferably is embodied as a package which an operator may mount to the blade at any convenient time. The attachment is inexpensive, lightweight yet strong and rigid, easy to mount and remove, simple in construction, and compatible with blades typically used on small home and farm tractors. The attachment includes an earth-loosening spike which is designed to require only a minimum amount of force to penetrate the earth or other material. The spike loosens the earth upon motion of the tractor in the backward direction and automatically pivots upwardly to drag along the surface in a non-working mode upon motion in the forward direction. The working position of the spike is optimally located by means of adjustment bushings, so that exacting placement of the attachment on the blade is not required. The spike is self-storing in an upright position without the aid of external devices.

BRIEF DESCRIPTION OF THE DRAWINGS

While the specification concludes with claims particularly pointing out and distinctly claiming the subject matter reqarded as forming the present invention, it is believed this invention will be better understood from the following description taken in connection with the accompanying drawings, in which:

FIG. 1 shows a small tractor of any suitable construction which is equipped with a blade and several of the pivotable spike attachments of the present invention.

FIG. 2 is a sectional view taken along line 2—2 of FIG. 4 and illustrates the invention mounted to the back side of a blade with the spike shown in the operative and inoperative positions.

FIG. 3 is a view taken along line 3—3 of FIG. 2.

DETAILED DESCRIPTION OF THE PREFERRED EMBODIMENT

Figure 4:
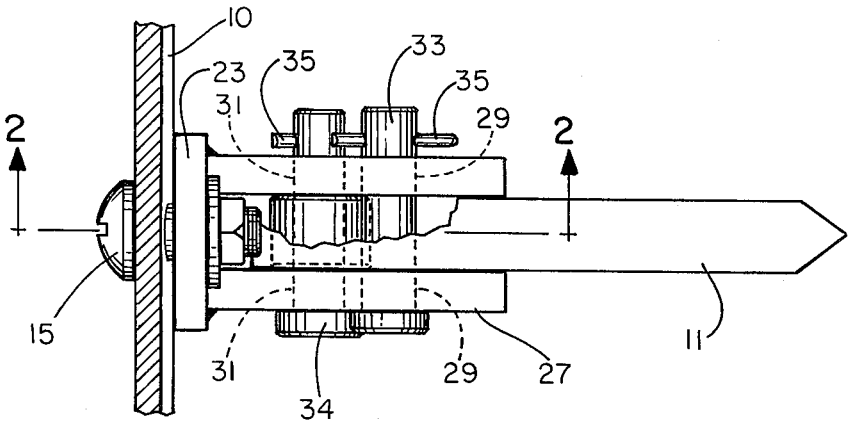
FIG. 4 is a view taken along line 4—4 of FIG. 2, but partially broken.

Referring to FIG. 1 of the drawings, reference numeral 1 indicates a typical small tractor commonly used by home owners and small-job contractors. Reference numeral 3 indicates a blade which is suitably connected to the front of the tractor by means of blade suspension system 5. Typically, a small tractor utilizes a handle 7 for mechanically actuating the suspension system, which is usually limited to raising and lowering the blade is a substantially vertical direction. The tractor, suspension system, and blade form no part of the present invention, except insofar as they furnish motive power and influence the operation of the invention. Several blade spike attachments embodying the subject matter of this invention, which are indicated generally by reference numeral 9, are advantageously mounted to the back side 10 of the blade. The number of spike attachments to be used is at the discretion of the tractor operator. We have found that four to six attachments yield excellent results for normal earth-loosening jobs, such as installing a home driveway. It is to be understood that the spike attachment embodying this invention is not limited to use on the particular model of tractor shown, but rather it may be employed on a wide variety of earth-moving vehicles.

As shown in FIG. 2, the spike assemblies 9 are mounted on the back side 10 of blade 3 such that spikes 11 protrude below the bottom edge 13 of the blade. The amount of protrusion is not critical; we have found that protrusions within the range of about two to four inches are satisfactory. It is also relatively unimportant that the protrusion of all the spikes be equal; a small variation on the order of 0.25 inch is acceptable.

Mounting an attachment 9 requires that two holes 21 be drilled through blade 3. The attachment is then detachably mounted to the blade by means of two screws 15 which pass through the holes 21 and corresponding holes 25 in base 23 of U-shaped bracket 24. Locating the lockwashers 17 and tightening nuts 19 complete the mounting requirements. It is possible that with some blade contours extensions 20 of base 23 may be drawn up tightly against surface 10 as the screws 15 are tightened.

Bracket 24 is provided with parallel side pieces 27 which are rigidly secured to base 23, as by welding. Coaxial apertures 29 and coaxial apertures 31 receive headed pivot pin 33 and headed reaction pin 34, respectively, each of which is retained within the bracket by a cotter pin 35.

Spike 11 is fabricated in the general shape of an elongated parallelopiped having a flat upper end 37. The spike is formed with an elongated aperture in the shape of a slot 39 located near the flat end. The spike is pivotally cradled within the bracket 24 by means of pin 33 passing through the slot. If desired, the spikes may easily and quickly be removed for sharpening or other reasons by merely removing cotter pins 35 and pulling pin 33 from one side piece 27. When the spike is in the operative position, it is forced upward so that slot surface 49 bears against the bottom side of pin 33. When the spike is dragging along the ground, slot surface 41 bears against pin 33. The lower end of the spike is tapered on three sides, at shown in FIG. 2 and FIG. 3, thus forming a point 45. Our experiments have determined that 45 degrees is a satisfactory back angle for the point, FIG. 2, and 15 degrees is a satisfactory side angle, FIG. 3.

We have found that the angle between the grade of the earth to be loosened and the longitudinal axis of spike 11 when the spike is in the earth-loosening position is very important to the proper operation of the invention. The optimum angle is between 70 and 75 degrees. Within that range, the spike tends to become self-digging, and it will bury itself into the earth or other material as the tractor is moved backward with a minimum of manual effort required on handle 7. If the angle between the spike and grade is less than about 70 degrees, the spike will tend to ride up onto the surface into the inoperative position, as illustrated in FIG. 2, instead of penetrating the earth. If the angle is greater than about 75 degrees, the spike will lose its self-digging qualities, and excessive force will be required on the handle to pierce the earth. The double angles forming point 45 greatly facilitate the initial penetration, thus permitting the spike to acquire a start for the self-burying action.

Reaction pin 34 performs a dual purpose. It serves as a reaction member for the forces created when the spike 11 is operated for loosening the earth. Pin 34 also acts as the support for adjusting bushings 47, whose function will now be described. The bushings 47, only one of which is shown, constitute the preferred means which enable the assembly 9 to be adapted to a wide variety of blade contours while permitting the desired spike protrusion below the blade lower surface 13 while simultaneously maintaining the desired 70 to 75 degree angle between the spike and earthgrade. It is apparent that the pivotal motion of the spike about pivot pin 33 is adjustably limited in the clockwise direction, as seen in the drawings, by the bushing and reaction pin. It is anticipated that several bushings having outer diameters which vary in increments of about 0.13 inch will be included with each attachment. The inner diameter of each bushing corresponds to the diameter of the reaction pin. The bushings are readily slipped onto the pin by removing cotter pin 35 and pulling the bushings out of hole 31. Thus, by using the correct diameter bushing, the operator can easily and quickly orient the spike of this invention to the optimum angle of 70 to 75 degrees regardless of the contour of his blade where the attachment is mounted.

Figure 5:
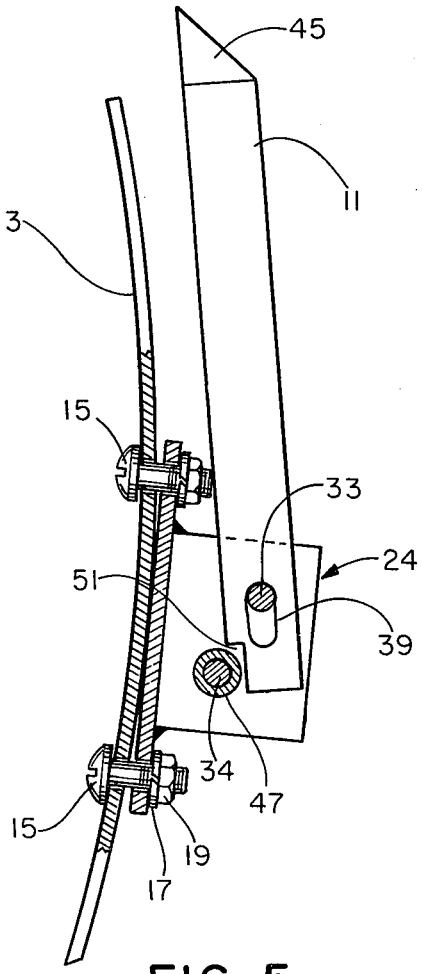
FIG. 5 is a view similar to that of FIG. 2, but which shows the spike in the upright stored position.

FIG. 5 illustrates spike 11 in the stored position. The function of slot 39 is to allow the spike to be positively retained in an upright position, where it is prevented from falling by bushing 47 and reaction pin 34 even during operations which produce severe vibrations.

To efficiently use the spike attachment embodying this invention, one or more assemblies 9 are mounted to a blade 3 as previously described. The proper bushing 47 is selected from those provided and is installed over pin 34 to obtain the optimum 70 to 75 degree angle between the spike axis and the earth grade. The operator raises the blade by means of handle 7 and suspension system 5 until the spikes dangle loosely. The operator next lowers the blade until points 45 contact the material to be loosened. He then moves the tractor or other vehicle in the rearward direction while simultaneously urging the blade downward through slight force on handle 7. Because the spikes are optimally oriented with the grade and because of the points formed by the double tapers, the spikes will tend to dig into the earth with only minimum force on the handle. Upon completion of the loosening stroke, the tractor is driven in the forward direction to scrape or otherwise move the loosened earth, and the spikes will pivot upwardly and drag inoperatively on the surface, as shown in FIG. 2.

Without further description, it is thought the advantages to be gained from the disclosed embodiment of our invention will be apparent to those skilled in the art. Furthermore, it is contemplated that various modifications and changes may be made to the pivotable blade spike attachment of the present invention within the scope of the appended claims without departing from the spirit of the invention. For example, it may be desirable that attachment 9 be permanently mounted to the blade 3, as by welding. In that event, protrusions 20 and mounting screws 15, lockwashers 17, and nuts 19 may be eliminated. As a further modification, base 23 may be fabricated with a curvature so that it conforms to the curvature of a particular blade surface 10. As a modified version of the adjustment bushings, the inner diameter of each successively larger bushing may correspond to the outer diameter of the next small bushing.

We claim:

1. In combination with an earth-working vehicle, a suspension system operatively connected to the vehicle, a blade joined to the suspension system, and means for actuating the suspension system, at least one earth-loosening attachment comprising:

a. a bracket mounted to the back side of the blade;

b. a pivot pin supported in the bracket;

c. a spike having a pointed lower end and an upper end, the spike containing an elongated aperture near the upper end for receiving the pivot pin so that the spike is cradled in the bracket and is suspended from the pivot pin for pivotal motion thereabout;

d. a reaction pin supported in the bracket; and e. at least one adjusting bushing coaxial with and supported by the reaction pin for adjustably limiting the pivotal motion of the spike in one direction, so that the spike has earth-loosening engagement at a predetermined angle with the earth during backward motion of the vehicle and has dragging action on the surface of the earth during forward motion of the vehicle.

2. The combination of claim 1 wherein there is at least one additional earth-loosening attachment having a spike that is adjustable independently of the first attachment spike to a different predetermined angle relative to the earth than the first attachment spike.

3. An earth-loosening spike and mounting therefor for earth-working blades comprising:

a. a bracket adapted to be detachably mounted to the back side of the blade;

b. a pivot pin supported in the bracket;

c. a reaction pin supported in the bracket;

d. a spike cradled in the bracket and suspended from the pivot pin for pivotal motion thereabout; and e. at least one tubular bushing of a predetermined outer diameter slideably mounted over the reaction pin to abut one edge of the spike and adjustably limit the pivotal motion of the spike in one direction to a first predetermined position.

4. The earth-working spike and mounting of claim 3 further comprising at least one additional bushing of predetermined outer diameter concentricly mounted over the first bushing to limit the spike pivotal motion to a second predetermined position.

5. An earth-loosening spike and mounting therefor for earth-working blades comprising:

a. a bracket adapted to be detachably mounted to the back side of the blade;

b. a pivot pin supported in the bracket;

c. a reaction pin supported in the bracket;

d. a spike cradled in the bracket and suspended from the pivot pin for limited pivotal motion thereabout, the spike having a pointed lower end and an upper end, the spike having a substantially vertical elongated aperture near the upper end for receiving the pivot pin and for aiding in retaining the spike in a stored position; and e. at least one adjustment bushing coaxial with and supported by the reaction pin for abutting one edge of the spike and adjustably limiting the pivotal motion of the spike in one direction.

6. In combination with an earth working vehicle, a suspension system operatively connected to the vehicle, a blade joined to the suspension system, and means for actuating the suspension system, at least one earth-loosening attachment comprising:

a. a bracket mounted to the back side of the blade;

b. a spike cradled in the bracket and suspended pivotally therefrom, the spike being adapted to have earth-loosening engagement with the earth during backward motion of the vehicle and to drag on the surface of the earth during forward motion of the vehicle; and c. at least one tubular adjustment bushing having a predetermined outer diameter supported within the bracket adapted to abut an edge of the spike to adjustably position the spike to a predetermined angle relative to the earth grade when the spike is in the earth-loosening position.

7. In combination with an earth-working vehicle, a suspension system operatively connected to the vehicle, a blade joined to the suspension system, and means for actuating the suspension system, at least one earth-loosening attachment comprising:

a. bracket mounted to the back side of the blade;

b. a spike cradled in the bracket and suspended pivotally therefrom, the spike being adapted to have earth-loosening engagement with the earth during backward motion of the vehicle and to drag on the surface of the earth during forward motion of the vehicle, the spike having a pointed lower end and an upper end, the upper end having an elongated slot for storing the spike in an upright stored position; and c. at least one adjustment bushing removably supported within the bracket for adjustably positioning the spike to a predetermined angle relative to the earth grade when the spike is in the earth-loosening position.

* * * * *